United States Patent [19]

Meyer et al.

[11] 3,964,380

[45] June 22, 1976

[54] APPARATUS FOR SECURING A SHEET OF MATERIAL INTO A ROLL

[75] Inventors: Charles H. Meyer; Donald H. Sheffield; George N. Willman, all of Dallas, Tex.

[73] Assignee: Mobil Oil Corporation, New York, N.Y.

[22] Filed: May 16, 1975

[21] Appl. No.: 578,046

[52] U.S. Cl. ..... 100/9; 242/67.3 R; 242/81; 346/136

[51] Int. Cl.[2] ..... B65B 13/02

[58] Field of Search ..... 100/4, 9; 242/71.1, 242/55.21, 81, 67.3 R; 53/3; 346/136, 24

[56] References Cited

UNITED STATES PATENTS

| | | | |
|---|---|---|---|
| 2,236,936 | 4/1941 | Camp | 100/9 |
| 2,660,507 | 11/1953 | Cordell | 346/24 X |
| 2,826,376 | 3/1958 | Wallin | 242/81 |

OTHER PUBLICATIONS

IBM Technical Bulletin – vol. 12, No. 2, July 1969.

*Primary Examiner*—Billy J. Wilhite
*Attorney, Agent, or Firm*—C. A. Huggett; Drude Faulconer

[57] ABSTRACT

An apparatus for handling sheets of material of various lengths such as consecutive plots from a computer printout device. The apparatus is comprised of a housing adapted to be affixed to a source such as the output section of a computer printout device. A takeup roller is mounted in the housing and is adapted to receive the material as it is fed from the source. When all of the material of a particular sheet has been rolled, a means ejects the material off the roller. As the roll of material is ejected from the roller, a securing means, e.g., elastic band, is automatically applied to the material to secure it in a rolled condition.

6 Claims, 3 Drawing Figures

APPARATUS FOR SECURING A SHEET OF MATERIAL INTO A ROLL

BACKGROUND OF THE INVENTION

This invention relates to a means for handling sheets of material of various lengths as they are fed from a source and more particularly relates to an apparatus for handling sheets of material such as paper from a computer printout device and automatically securing said sheets into individual rolls.

There are many operations, commercial and otherwise, wherein a continuous roll of material is used as supply for a plurality of individual, consecutive operations, each of which requires only a portion of said material. In such operations, the material used is normally cut from the roll after a particular operation has been carried out so that said material is available in individual, separate sheets, each representing a separate operation. For example, in certain operations for processing seismic data, a continuous roll of printout paper is fed through an electrostatic plotter coupled to a computer. After a particular computer printout is recorded on the paper, that particular portion of the paper is cut from the roll so that it may later be individually retrieved for analysis. Where the plotter is unattended as is often the case or where a particular plot is of undue length, difficulties sometime arise in handling the various lengths of paper as they are cut from the roll.

Presently one technique for handling the paper is merely to cut the paper at the end of a plot printout and let it drop loosely into a basket or the like. The various lengths are later retrieved from the basket and then manually rolled or folded into individual packages. Another technique utilizes a takeup roller driven by a torque motor to roll the paper as it is fed from the plotter but this requires an operator to be present to manually remove an individual roll of paper from the roller at the conclusion of each particular plotting operation.

SUMMARY OF THE INVENTION

The present invention provides an apparatus for handling sheets of material of various lengths such as consecutive plots from a computer printout device. Specifically, the present apparatus receives these sheets and automatically secures them into individual rolls without requiring an operator to be present.

Structurally, the present apparatus is comprised of a housing which is adapted to be affixed to a source, e.g., the output section of a computer printout device, such as a plotter for seismic data. A takeup roller, driven by a torque motor, is mounted in the housing and is adapted to receive the printout paper as it is fed into the housing from the plotter. Flexible fingers attached to the roller guide the paper within the housing until the paper is formed into a roll around the takeup roller. At the end of a particular plotting operation the printout paper is cut. A means is then actuated to eject the roll of paper off the roller and out of the housing. As the roll of paper is ejected from the housing, a securing means, e.g., elastic band, is automatically applied to the paper to secure it in its rolled condition. The secured roll then drops into a basket or the like from which it may be individually retrieved. The apparatus automatically recycles and is ready to receive the next length of paper.

BRIEF DESCRIPTION OF THE DRAWINGS

The actual construction, operation, and the apparent advantages of the present invention will be better understood by referring to the drawings in which like numerals identify like parts and in which.

DESCRIPTION OF THE PREFERRED EMBODIMENT

Figure 1:
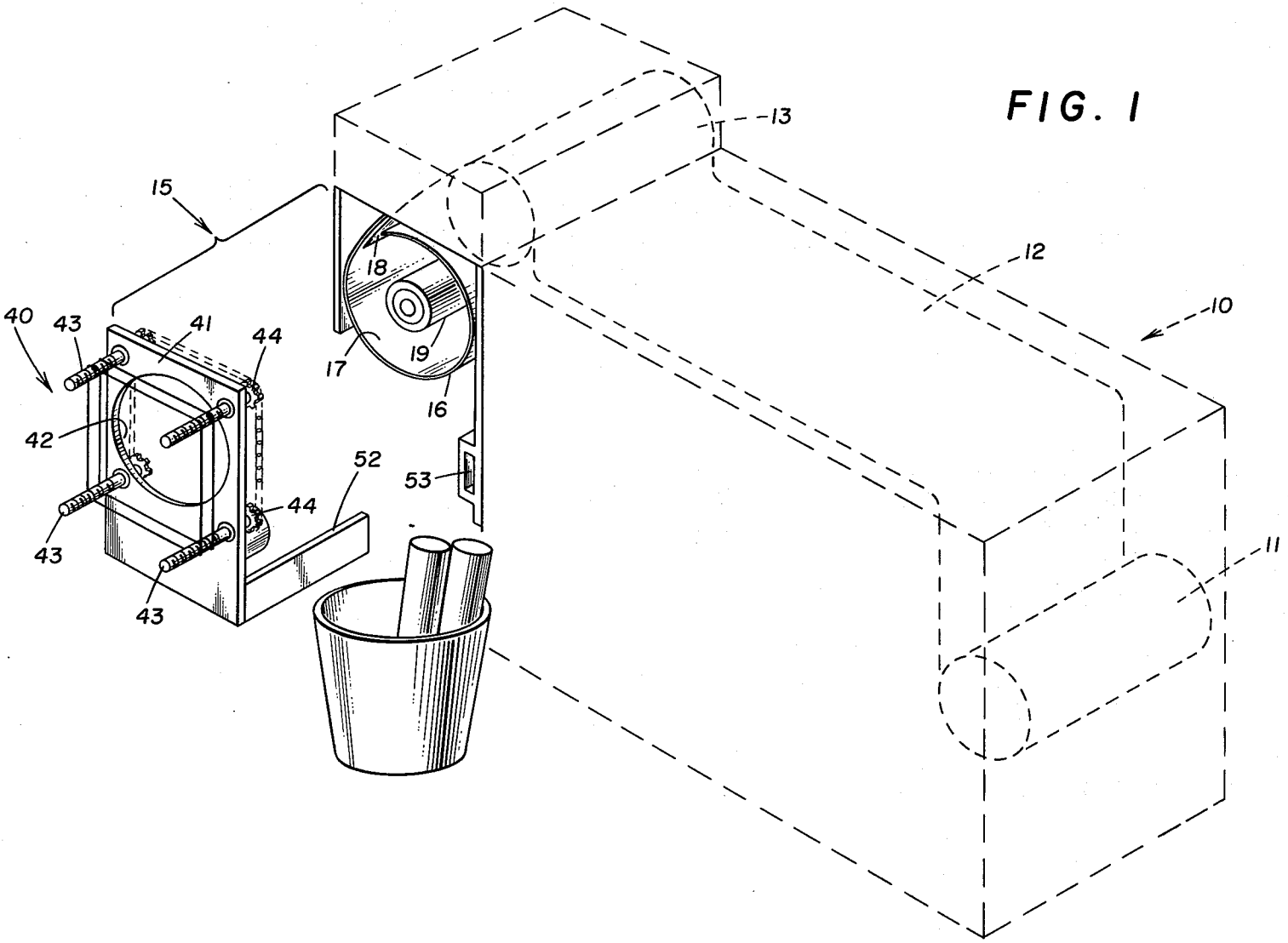
FIG. 1 is an exploded, perspective view of the present invention in combination with a commercial computer printout device, the latter being shown in phantom lines.

Although, for ease of illustration, the present invention is described in combination with a printout device for a computer, it should be recognized that the present invention is also capable of handling sheets of paper or like material from other sources. Likewise, while the printout device illustrated in the drawings takes the shape of a commercially available electrostatic plotter used for plotting seismic data fed from a computer, the present invention may also be used in combination with other available printout or like devices.

Referring more particularly to the drawings, FIG. 1 shows the present invention 15 in combination with plotter 10 which is illustrated in phantom lines. Plotter 10 is a commercially available apparatus adapted to record seismic data from a computer (not shown) onto a continuous roll of paper 11 as the paper is fed through printout section 12 of plotter 10. Paper 11 passes from section 12 into output section 13 from which the paper would normally fall loosely into a container or the like (not shown). Upon command from the computer, a cutter (not shown) in output section 13 will cut the used paper from the continuous roll 11, as is well known in the art.

Figure 2:
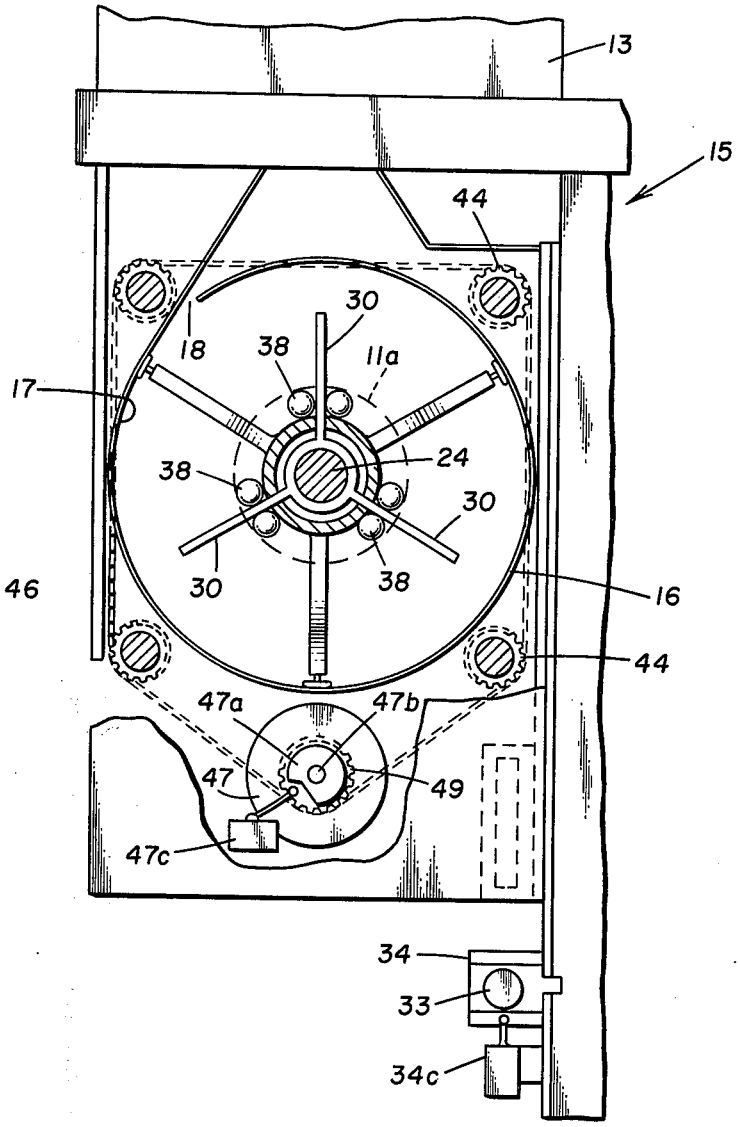
FIG. 2 is an end view, partly in section, of the present invention.
Figure 3:
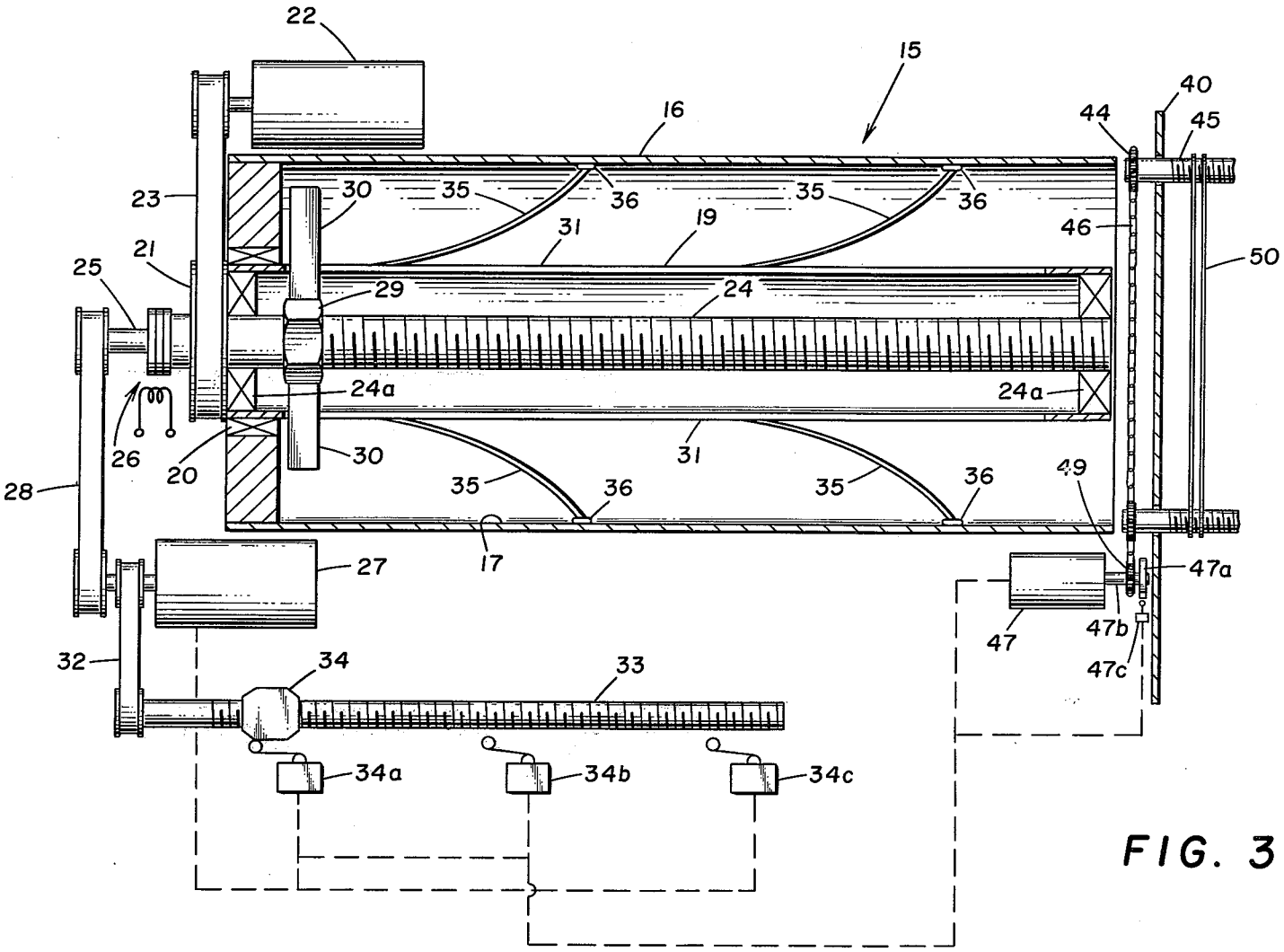
FIG. 3 is a plan view, partly in section, of the present invention.

In accordance with the present invention, apparatus 15 is affixed to plotter 10 beneath section 13 as shown in FIG. 1. Apparatus 15 is comprised of a housing 16 having a substantially cylindrical internal chamber 17 throughout its length (FIGS. 1, 2 and 3). An inlet slot 18 is provided in housing 16 for receiving paper 11 as it exits from section 13 of plotter 10. Take-up roller 19 is journaled concentrically within chamber 17 by means of bearing 20 at one end of housing 16 (FIG. 3) and extends substantially throughout the length of chamber 17. The opposite end of chamber 17 is open. Pulley 21 is affixed to roller 19 and is driven by torque motor 22 by means of belt 23. Torque motor 22 is the type of known motor that allows its drive shaft to slip if a specified torque thereon is exceeded.

Rotatably and concentrically mounted within hollow roller 19 by means of bearing **24*a* is eject lead screw 24 which extends from housing 16 and is releasably coupled to shaft 25 by electrically actuated clutch 26. Shaft 25 is driven by eject motor 27 through belt 28. Eject follower 29 is threaded onto eject lead screw 24 and has a plurality of eject members 30 integral therewith which extend outward from follower 29 through slots 31 which run the substantial length of roller 19. By means of belt 32, eject motor 27 also drives switch lead screw 33 (shown schematically in FIG. 3) which is mounted on housing 16 outside of chamber 17. Switch follower 34 is threaded onto switch lead screw 33 and is adapted to actuate switches 34***a*, 34*b*, and 34*c* as it moves along screw 33. The purposes of switches 34*a*, 34*b*, 34*c* will be set out below in the description of operation.

Secured to the outer surface of roller 19 is a plurality of flexible fingers 35, each of which preferably has a soft tip 36, i.e., rubber, thereon. Fingers 35 are preferably made from thin strips of spring steel or the like and are designed to be naturally biased outward into contact with the wall of chamber 17 when in a normal position. The purpose of these fingers will become evident from the description of operation set forth below.

Preferably also secured to the outer surface of roller 19 and extending substantially throughout the length of roller 19 are rods 38 which are positioned as shown in FIG. 2. The purpose of these rods is to reduce the contact area between a roll of paper (shown by dotted lines 11*a*) and roller 19, thereby aiding in ejecting the roll when desired.

Means 40 is adapted to be removably attached to housing 16 at the open end of chamber 17 and is adapted to apply a securing means to a roll of paper as it is ejected off roller 19, as will be more fully described below. Means 40 is comprised of support 41 having a large opening 42 therethrough which is substantially aligned with the open end of chamber 17 when means 40 is in its operable position. A plurality of members 43 are rotatably mounted through support 41 at spaced intervals around opening 42, as shown in the drawings. Each member 43 has a gear 44 affixed on its inner end and is identically threaded on its outer end 45. Chain 46 or the like meshes with gears 44 on members 43 and with gear 49 on the shaft of motor 47 so that all members will rotate simultaneously and in unison when chain 46 is driven by motor 47. Securing means 50, e.g., elastic bands such as ordinary rubber bands, are positioned on members 43 as shown in FIGS. 1 and 3. Each elastic band 50 is stretched around a corresponding thread of each member 43 so that the elastic bands will be expelled one by one upon each complete revolution of members 43. Means 40 is removably attached to housing 16 by means of bar 52 on support 41 which slides into slot 53 on housing 16. Also, the necessary electrical connection, e.g., male-female connection (details not shown) for operating motor 47 is preferably completed when bar 52 mates with slot 53. Means 40 is preferably made for easy removal for ease in loading members 43 with elastic bands when needed.

The operation of apparatus 15 is as follows. Upon plotter 10 receiving a command from a computer to begin plotting data, as known in the art, torque motor 22 is also energized to rotate roller 19 at a desired speed. As mentioned above, motor 22 is of the type commonly referred to as a torque motor and is designed to slip if a certain torque load is exceeded. This prevents tearing of the paper if the feed of paper should stop or slow down while motor 22 continues to rotate roller 19.

As paper 11 exits from section 13 of plotter 10, it enters chamber 17 through slot 18 in housing 16. Tips 36 on fingers 35 engage paper 11 as it enters chamber 17 and due to rotation of roller 19 will guide the paper along the wall of chamber 17 until the leading edge 11 travels completely around the chamber. Then, layer-to-layer adhesion of the paper in contact with itself and the fact that the rotational speed of roller 19 slightly exceeds the feed rate of the paper causes the roll of paper within the chamber to tighten around roller 19 or into contact with rods 38, if present. As the roll of paper tightens, it inherently forces fingers 35 inward against their natural biases to a position against roller 19.

When a particular plot is completed and has passed through section 13, the computer commands section 13 to cut paper 11. Torque motor 22 continues to rotate roller 19 for a short time, e.g., 0.5 second, to insure that all of the paper has been rolled. At the end of the above-mentioned delay, torque motor 22 is stopped and the eject means is actuated. Electric clutch 26 is engaged and eject motor 27 is started to rotate eject lead screw 24, thereby driving eject follower 29 toward the open end of chamber 17. As eject follower 29 moves on eject lead screw 24, eject members 30 engage the roll of paper and begin to push the roll off roller 19. At the same time, eject motor 27 also drives switch lead screw 33 to move switch follower 34 toward the right as viewed in FIG. 3. When the roll of paper is approximately half way off roller 19, switch follower 34 actuates switch 34*b* which in turn starts motor 47 to rotate members 43. Cam 47*a* (FIGS. 2 and 3) is affixed to drive shaft 47*b* of motor 47 and is designed to trip switch 47*c* to stop motor 47 after one complete turn of members 43. As members 43 rotate one complete revolution, the outermost elastic band 50 is "threaded" off each member 43 simultaneously and drops onto approximately the middle of the roll of paper to thereby secure the paper in its rolled condition.

Eject motor 27 continues to drive both eject lead screw 24 and switch lead screw 33 until eject follower 29 reaches substantially the end of roller 19 and eject members 30 completely push the paper off roller 19 and out chamber 17 where it falls into a container or the like. At the same time, switch follower 34 reaches the end of its travel on switch lead screw 33 and actuates switch 34*c* which reverses eject motor 27. Both eject lead screw 24 and switch lead screw 33 are now rotated in the opposite direction to return both eject follower 29 and switch follower 34 to their respective original positions. As switch follower 34 reaches its original position, it actuates switch 34*a* to stop eject motor 27 and disengage clutch 26. Apparatus 15 has now recycled and is ready to receive the next plot.

What is claimed is:

1. A take-up apparatus for handling sheet material as it is fed from a source, said apparatus comprising:

a housing having a chamber therein, said chamber being open at one end;

an opening in said housing adapted to receive the material and direct it into said chamber;

a roller rotatably mounted within said chamber and extending substantially throughout the length of said chamber;

means to rotate said roller;

means for guiding said material onto said roller;

means for ejecting said material from said roller and out said open end of said chamber after said material has been rolled on said roller; and means for securing said material in its rolled condition as said material is ejected from said roller.

2. The take-up apparatus of claim 1 wherein the means for guiding said material onto said roller comprises:

a plurality of flexible fingers attached to said roller and biased into contact with the wall of said chamber when in their normal position.

3. The take-up apparatus of claim 2 wherein said means for securing said material comprises:

a support having an opening therethrough substantially aligned with said open end of said chamber;

a plurality of members rotatably mounted on said support at spaced intervals around said opening, said members being threaded on their outer ends;

at least one elastic band positioned on corresponding threads on each of said members; and means for rotating said plurality of said members simultaneously, thereby displacing said at least one elastic band from each of said members at substantially the same instant as said members are rotated.

4. The take-up apparatus of claim 3 wherein said means for ejecting said material from said roller comprises:

an ejection lead screw rotatably and concentrically mounted within said roller, said screw extending substantially throughout the length of said roller;

an ejection follower threadedly positioned on said ejection lead screw;

a plurality of ejection members attached to said ejection follower, each of said ejection members extending from said ejection follower through a respective longitudinal slot provided in said roller; and means for rotating said ejection lead screw.

5. The take-up apparatus of claim 4 including:

a second lead screw on said housing;

a cam follower threadedly positioned on said second lead screw;

means for rotating said second lead screw simultaneously with said ejection means ;

first switch means actuated by said cam follower as it moves along said second lead screw to in turn actuate said means for rotating said member holding said at least one elastic band;

second switch means actuated by said cam follower to reverse said means rotating both said ejection lead screw and said second lead screw to thereby return said ejection follower and said cam follower to their respective original position; and third switch means actuated by said cam follower to stop said means for rotating both said ejection lead screw and said second lead screw when said ejection follower and said cam follower have returned to their respective original positions.

6. The take-up apparatus of claim 5 including:

a plurality of rods secured to said roller and extending substantially throughout the length thereof, said rods spaced about the circumference of said roller to thereby reduce the contact area between said material and said roller.

* * * * *